US008146761B2

(12) United States Patent
Fawley

(10) Patent No.: US 8,146,761 B2
(45) Date of Patent: Apr. 3, 2012

(54) INTERMODAL CONTAINER FOR TRANSPORTING NATURAL GAS

(75) Inventor: Norman C. Fawley, Cayucos, CA (US)

(73) Assignee: NCF Industries, Inc., Cayucos, CA (US)

( * ) Notice: Subject to any disclaimer, the term of this patent is extended or adjusted under 35 U.S.C. 154(b) by 1233 days.

(21) Appl. No.: 11/651,316

(22) Filed: Jan. 8, 2007

(65) Prior Publication Data

US 2008/0164251 A1 Jul. 10, 2008

(51) Int. Cl.
*B65D 21/02* (2006.01)
*B65D 88/00* (2006.01)

(52) U.S. Cl. ..... 220/1.5; 220/23.86; 220/23.87; 220/23.89

(58) Field of Classification Search ..... 220/1.5, 220/23.86, 23.87, 23.89, 529, 530, 532
See application file for complete search history.

(56) References Cited

U.S. PATENT DOCUMENTS

| | | | | | |
|---|---|---|---|---|---|
| 4,060,174 | A * | 11/1977 | Gerhard | 220/23.4 |
| 4,359,084 | A * | 11/1982 | Geverath et al. | 165/297 |
| 4,416,384 | A * | 11/1983 | Bjurling | 220/1.5 |
| 4,441,678 | A * | 4/1984 | Dorpmund | 248/146 |
| 5,447,407 | A * | 9/1995 | Weaver et al. | 414/528 |
| 5,960,974 | A * | 10/1999 | Kee et al. | 220/1.5 |
| 6,015,055 | A * | 1/2000 | Bonerb et al. | 220/1.5 |
| 7,494,308 | B2 * | 2/2009 | Chun | 410/47 |
| 2006/0099366 | A1 * | 5/2006 | Takemoto et al. | 428/36.1 |

* cited by examiner

*Primary Examiner* — Anthony Stashick
*Assistant Examiner* — Madison L Wright
(74) *Attorney, Agent, or Firm* — Blakely Sokoloff Taylor & Zafman LLP

(57) ABSTRACT

An apparatus and method for transporting compressed gases or similar materials. The apparatus includes an exterior housing dimensioned for intermodal transportation that contains a rack that holds pressure vessels. The apparatus may be loaded with pressure vessels and the vessels filled within the apparatus. The apparatus may be transferred between modes of transportation along a delivery route without unloading the vessels from the apparatus.

4 Claims, 6 Drawing Sheets

INTERMODAL CONTAINER FOR TRANSPORTING NATURAL GAS

BACKGROUND

1. Field of the Invention

The present invention relates to an apparatus and method for transporting compressed gas. Specifically, embodiments of the invention relate to intermodal containers for transporting compressed gas within pressure vessels and methods for the manufacture and use thereof.

2. Description of the Related Art

Gases and similar materials require specialized pressurized containers for transportation. Natural gas and similar materials are often mined at locations that are remote from refineries and storage facilities, as well as the end users of the materials. Large volumes of pressurized gas are transported from field to market using multiple forms of transportation.

Pipelines are one traditional form of transportation. However, pipelines are expensive and time consuming to install over significant distances. Transportation of gas via pipelines raises political issues relating to the construction and control of the pipeline. Pipelines often pose regulatory and environmental challenges as well. Due to these challenges, the costs of creating and utilizing a pipeline often make them infeasible as solutions in many situations.

Pressure vessels are another way to transport gas from the field to market. Pressure vessels come in many forms and may be built especially for use with gases stored at very high pressure. Moving compressed gas in pressure vessels over long distances typically requires multiple modes of transportation. The compressed gas within the pressure vessels must be transferred from one mode of transportation to another along the route to the target destination. At each transfer point along the route, the gas must be emptied from one set of pressure vessels and used to fill another set of pressure vessels for the next leg of the journey. For example, a cargo ship having a set of pressure vessels is used to transport compressed gas from its country of origin to a destination country by sea. When the ship arrives at the destination country, the compressed gas is transferred from pressure vessels aboard the cargo ship to pressure vessels aboard a train or truck (i.e., a tube trailer) or into a pipeline for transport deeper into the destination country. Alternatively, the pressure vessels may be physically transferred one by one from the ship to other forms of transportation such as the train or truck. Both of these transfer methods are time consuming and require specialized equipment for pumping the materials in the vessels or transferring individual pressure vessels. This increases the cost of shipping the materials in the pressure vessels.

DESCRIPTION OF THE DRAWINGS

Embodiments of the invention are illustrated by way of example and not by way of limitation in the figures of the accompanying drawings in which like references indicate similar elements. It should be noted that different references to "an" or "one" embodiment in this disclosure are not necessarily to the same embodiment, and such references mean at least one.

DETAILED DESCRIPTION

In the following description, for the purpose of explanation, numerous specific details are set forth to provide a thorough understanding of the various embodiments. It will be apparent to one of ordinary skill in the art that the embodiments may be practiced without some of these specific details. In other instances, certain structures and devices are omitted or simplified to avoid obscuring the details of the various embodiments.

The following description and the accompanying drawings provide examples for the purposes of illustration. However, these examples should not be construed in a limiting sense as they are not intended to provide an exhaustive list of all possible implementations.

Figure 1:
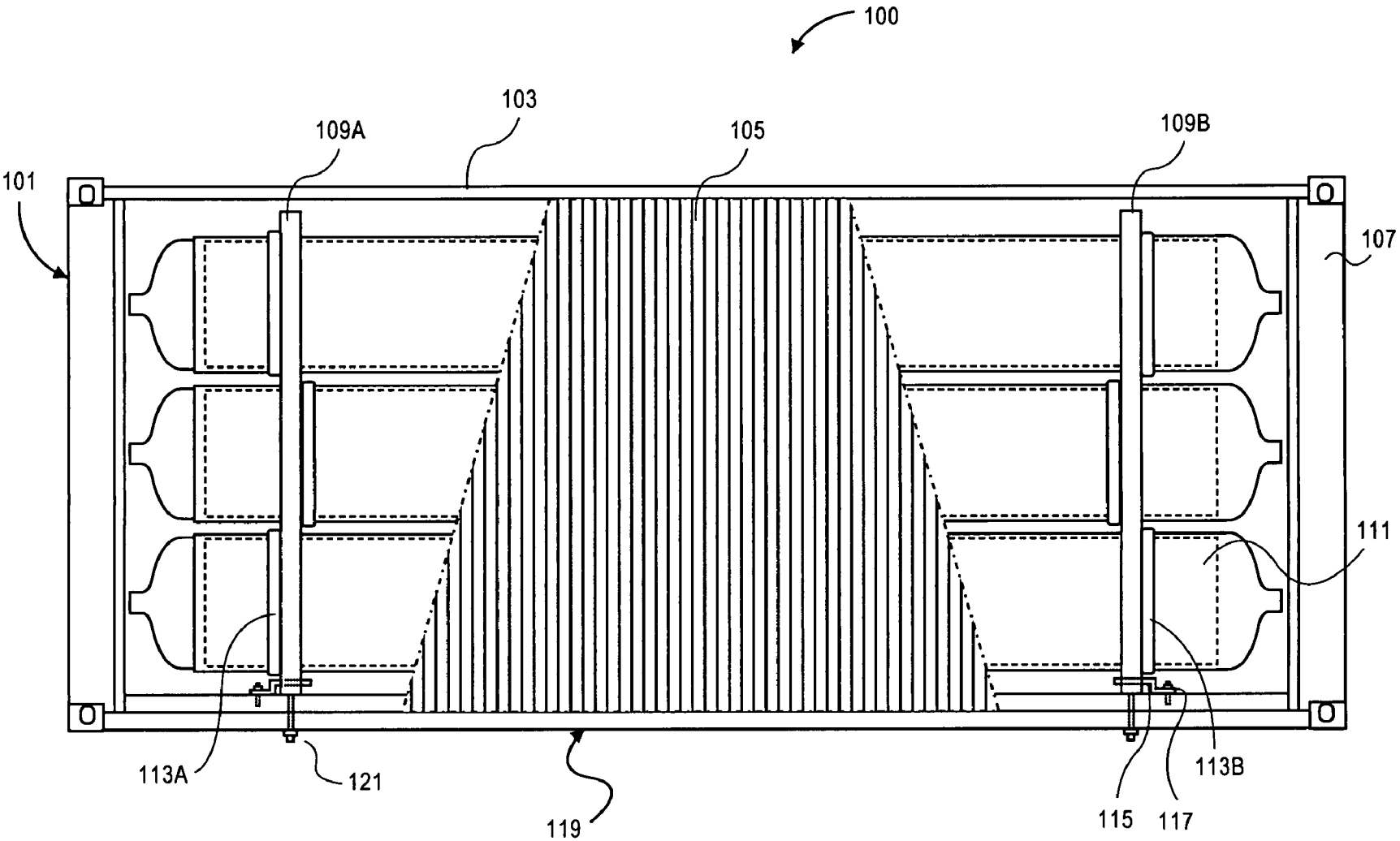
FIG. 1 is a diagram of one embodiment of an intermodal transportation unit.

FIG. 1 is a diagram of one embodiment of an intermodal transportation unit 100. The intermodal transportation unit 100 may include an exterior housing 119, such as a 688 dry van container. In one embodiment, the exterior housing 119 may be cuboid in shape, such as a box or similar shape. In other embodiments, the exterior housing 119 may have other geometric shapes or irregular shapes. In one example embodiment, the external housing 119, such as the 688 dry van container may be approximately twenty or forty feet in length (dependent on model), eight and a half feet in height and eight feet wide. The intermodal transportation unit 100 may have any dimensions suitable for its purpose. The intermodal transportation unit 100 may be sized to fit specific modes of transport such as truck trailers, train cars, ship holding areas and similar modes of transportation. In another embodiment, the intermodal transportation unit 100, may be designed to be used with multiple modes of transport meeting the restrictions of each mode.

The external housing 119 may include a frame 103 and a set of sidewalls 105. A set as used herein may refer to any number of items including one item. The frame 103 may be made of a high strength metal such as steel, alloys thereof, titanium, iron or similar materials. The side panels 105 may be formed from metals, plastics or other similar materials. In one embodiment, the frame 103 and side panels 105 may be made from non-combustible or flame retardant materials to protect the contents from fire. The external housing 119 also serves to protect the contents from theft, weather, impact, or similar hazards and masks the identity of the contents and provides similar benefits.

In one embodiment, the side panels 105 may be removeably attached to the frame 103 or fixed to the frame 103 by welding, riveting or similar attachment mechanisms. In one embodiment, the frame 103 and sidewalls 105 may form a complete enclosure. This enclosure may be water tight, air tight, weather proofed or similarly sealed. Extra panels may also be present in the sidewalls including the ceiling and floor panels to protect the contents from heat, cold, forced entry, impact or similar conditions and events.

In one embodiment, the external housing 119 may reduce the effects of a nearby heat source such as a fire. The intermodal transportation unit 100 has been tested by being exposed to a pan fire test conducted by the Office of Hazardous Material Technology. In the test, the pan holds 150 gallons and is 12 foot by 24 foot in size. 150 gallons of Jet A fuel are burned in the pan over a period of thirty minutes. A pressure vessel exposed directly to this heat source reached a peak temperature of 1161 degrees Fahrenheit. A pressure vessel on a conventional truck trailer reached a peak temperature of 1005 degrees Fahrenheit when exposed to the same conditions. However, a pressure vessel in the intermodal transportation unit 100 exposed to the same conditions maintained a temperature below 225 degrees Fahrenheit for the full thirty minutes. These tests provide an example of the fire protection attributes of an intermodal transportation unit 100 containing a set of pressure vessels. In other embodiments, similar fire protection is provided for other types of objects that may be placed within the intermodal transportation unit 100.

In one embodiment, the external housing 119 may include a set of front 101 and rear doors 107. The doors 101, 107 may be removeable side panels, hinged doors, sliding doors or similar types of doors or access panels. In another embodiment, other side panels may be configured as doors or access panels. In a further embodiment, only a single set of doors may be present to allow access to the pressure vessels 111 within the exterior housing 119. Doors and access panels may have locking mechanisms or similar mechanisms to secure the internal components of the unit.

Figure 2A:
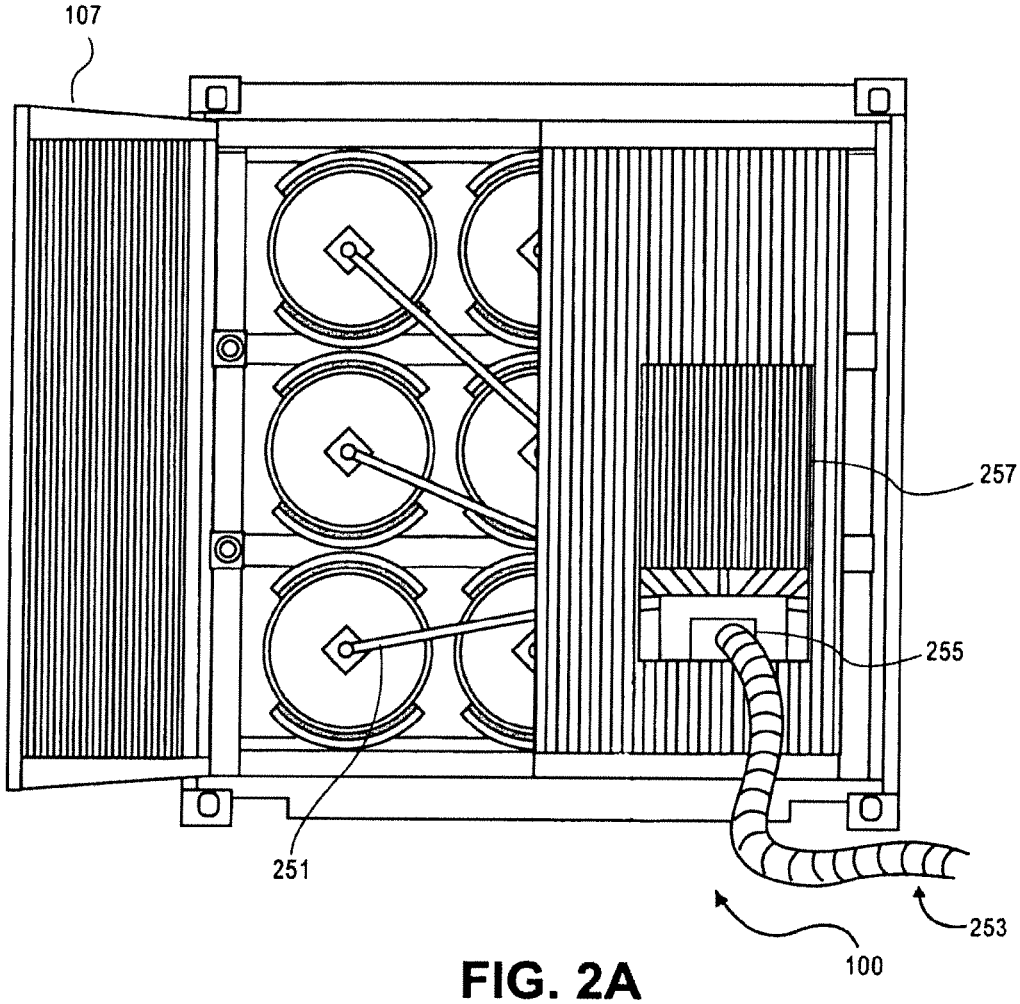
FIG. 2A is a diagram of one embodiment of the intermodal transportation unit with a manifold and access panel.

FIG. 2A is a diagram of one embodiment of an end view of an intermodal transportation unit showing a set of doors with an access panel. The doors 107 open and close to provide access to the contents of the intermodal transportation unit 100. In one embodiment, the doors 107 may include a smaller access panel 257. This panel 257 may be connected by hinge, by slide mechanism or similar attachment mechanism that allows the access panel to be opened. The access panel 257 may be used to gain access or limited access to the interior compartment of the intermodal transportation unit 100 if the doors are closed.

In one example embodiment, the access panel 257 may be used to connect a set of pressure vessels and a manifold 251 connected to those pressure vessels to an external pump to load or unload the contents of the pressure vessels. The pump may be connected to the manifold 251 through the port 255 created by the open access panel 257 through a hose 253 or similar mechanism. This increases the ease in which the contents of the intermodal transportation unit 100 may be loaded and unloaded. In one example use, the access panel 257 may be used to connect the pressure vessels to a pumping system on a transport such as a ship. Each pressure vessel may be individually accessed by a pumping system or a central valve may be present in the manifold to allow simultaneous access to the pressure vessels.

Figure 2B:
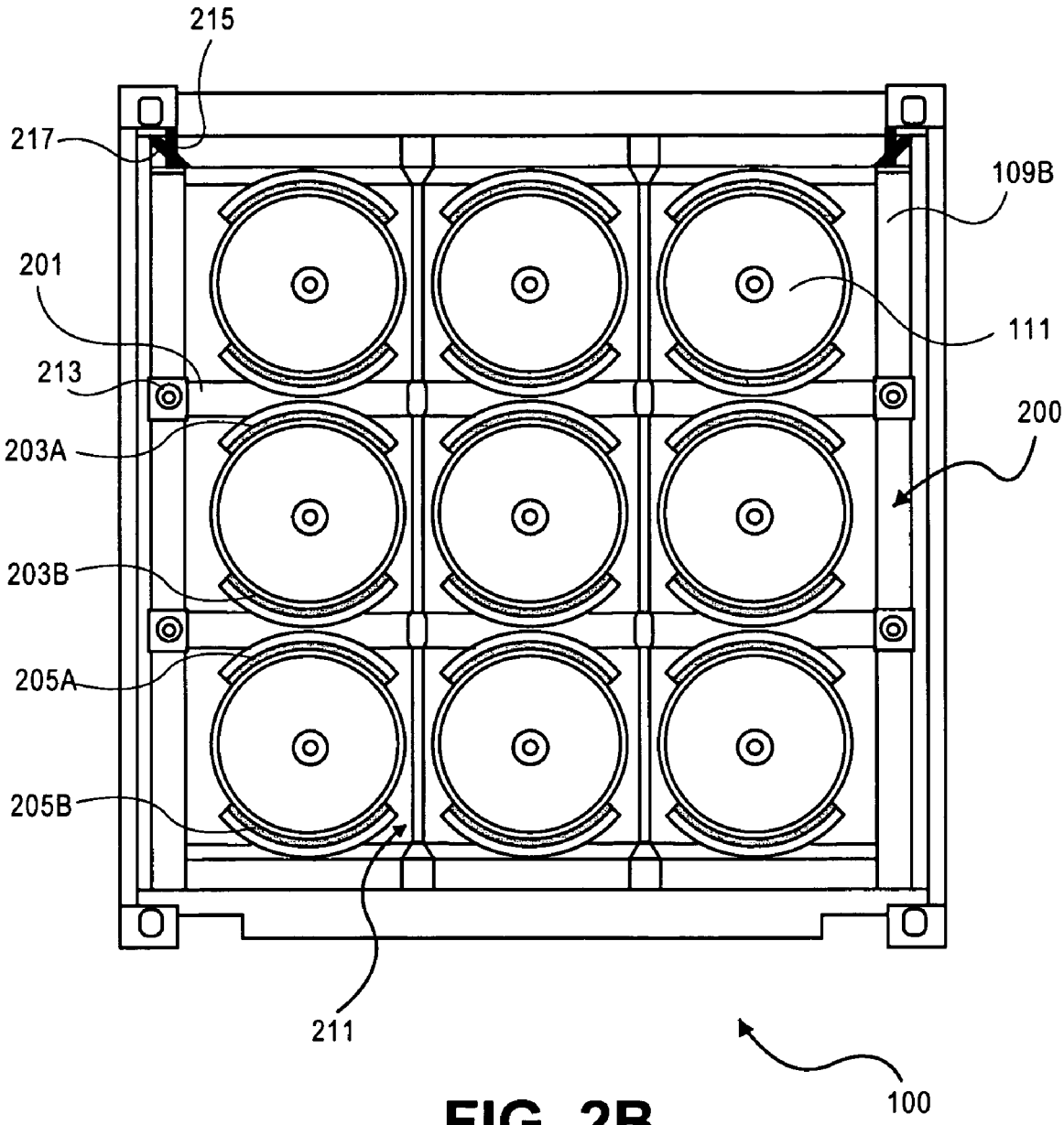
FIG. 2B is a diagram of one embodiment of the intermodal transportation unit without doors and without a manifold to show the rack structure.

Returning to a discussion of FIG. 1, in one embodiment, the intermodal transportation unit 100 may include a rack to hold a set of pressure vessels 111. The rack may include a set of stands 109A, 109B each supporting a set of crossbars. The stands 109A, 109B may be independent of one another or may be connected to one another for support. FIG. 2B is a diagram showing one embodiment of a configuration of the rack 200. In one example embodiment, the rack 200 may include four crossbars 201 creating three rows for storing pressure vessels 111. Any number of crossbars 201 may be utilized dependent on the size of the intermodal transportation unit 100 and the size of the pressure vessels 111. Also, additional vertical bars or stands may be utilized in the rack to provide additional support to the pressure vessels 111. For example, a set of stress rods 211 may reinforce the stand 109. Any number of stress rods 211 may support the rack 200. Any number of columns of pressure vessels may be defined by the rack 200. The stand 109B, crossbars 201 and stress rods 211 may be formed from metals such as steel or aluminum, or other similar materials with sufficient material strength to support the weight of a set of pressure vessels 111. For example, the stress rods 211 may be ⅞ inch diameter steel rods.

Crossbars 201, stress rods 211 and stands 109A, 109B may be welded together, interlocking or similarly connected. In one embodiment, the connections may be reinforced by bolts through the joints between the crossbars 201, stress rods 211 and stands 109A, 109B. In one embodiment, the holes may be drilled and the bolts 213 inserted after the rack has been loaded and compressed by a compression mechanism 215 or preloaded to simulate the weight of full pressure vessels. For example, a bottom row of the rack 200 may be loaded with pressure vessels and a crossbar placed over them. The next row is loaded on a crossbar placed over the pressure vessels. This process may repeat until all the rows are loaded. The compression mechanism 215 may exert pressure on a top crossbar to settle the pressure vessels into place and exert a compressing force to hold them in place. The compression mechanism 215 holds or clamps the rack 200 and the pressure vessels on the rack 200 in a compressed or secure position. The holes for the bolts may then be drilled and the bolts 213 inserted to hold the structure in place. The compression mechanism 215 may be any tightening or force exerting mechanism including a clamping mechanism, spring mechanism, tightening bolt or similar compression mechanisms. Diagonal support mechanism 217 may provide additional support to rack 200 and prevent lateral movement of rack 200.

In one embodiment, the reinforcement provided by the stress rods 211 may improve the strength of the intermodal transportation unit 100 in the event of a rollover. The combination of the crossbars 201 and stress rods 211 maintain the shape of the rack 200 and protect the pressure vessels 111. This structure also assists in holding the pressure vessels 111 in place when placed under the stress of sharp turns or impacts.

In one embodiment, each crossbar 201 may have a set of positioning members 203A, 203B. The positioning members 203A, 203B may have a shape complimentary to the exterior cross-sectional shape of the pressure vessels 111 to secure the pressure vessels 111 during transport. The positioning members 203A, 203B may be attached to the crossbars 201 by welding, adhesion, riveting or similar attachment mechanisms. In another embodiment, the positioning members 203A, 203B may be integrally formed with the crossbars 201. The positioning members 203A, 203B of each crossbar 201 define the placement of the pressure vessels 111 within the rack 200. Any number of pressure vessels 111 may be accommodated by the rack 200 dependent on the size of the intermodal transportation unit 100, size of the pressure vessels 111 and spacing of positioning members 203A, 203B.

In one embodiment, a set of friction members 205A, 205B may be attached to the positioning members 203A, 203B to reduce the longitudinal movement of the pressure vessels 111 during transport. The friction members 205A, 205B may be a natural material such as rubber, a synthetic material or any material capable of providing sufficient surface friction to prevent or minimize the longitudinal movement of the pressure vessels. In one embodiment, the friction members 205A, 205B may have elastomeric properties to accommodate expansion of the tubes during filling or due to changes in temperature. The friction members 205A, 205B may be welded, adhered, form fit or similarly attached to the positioning members 203A, 203B. The friction members 205A, 205B may be friction enhancing cushions and provide padding to cushion the pressure vessels 111 during transport. In one embodiment the friction members may be made of tire rubber.

Returning to the discussion of FIG. 1, the rack stands 109A, 109B may be positioned adjacent to each end of the pressure vessels 111 to provide a level support for each pressure vessel 111. In one example embodiment, two stands 109A, 109B are present in the intermodal transportation unit 100. In another embodiment, any number of stands may be utilized along the length of the pressure vessels 111 to provide support during transport. In one embodiment, the rack stands 109A, 109B provide support and secure the pressure vessels 111 along a body portion of the pressure vessels and do not support the pressure vessels 111 at the neck portion. Supporting the pressure vessels 111 in the neck portion may cause a higher level of wear and limit the lifespan of the pressure vessels.

Figure 3:
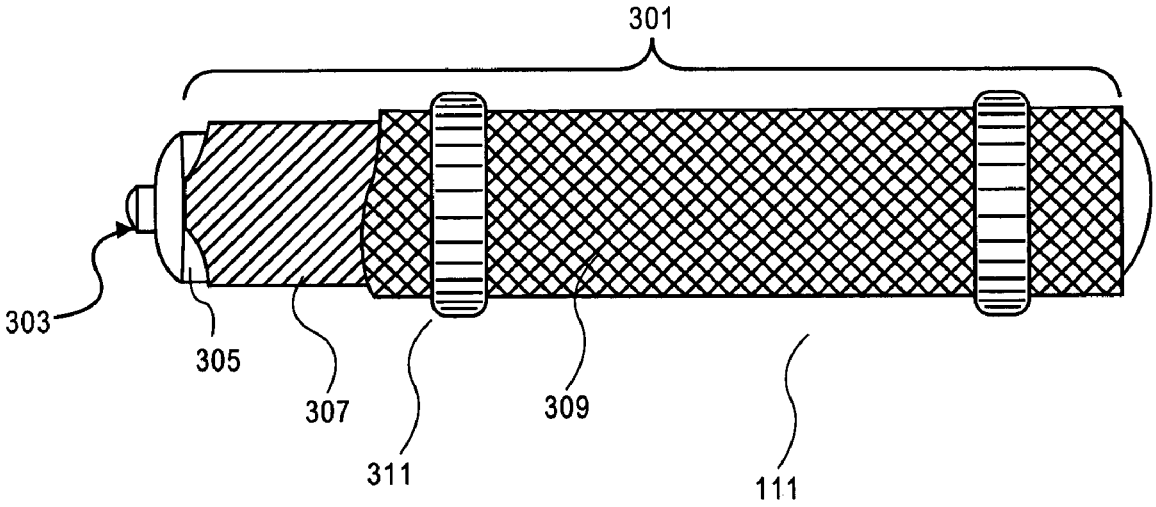
FIG. 3 is a diagram of one embodiment of a pressure vessel.

FIG. 3 is a diagram of one embodiment of a pressure vessel 111. The pressure vessel 111 may have a body portion 301 and a neck portion 303. The neck portion 303 defines an opening for filling and empting the vessel 111. The pressure vessel 111 may include an inner core 305. The inner core 305 may be composed of steel, steel alloys, carbon steel, monel, inconel, hastelloy, titanium and similar materials. The inner core 305 may be encased in a composite reinforcement layer 307. The composite reinforcement layer 307 may be an isopolyester resin matrix, polyester, aramid or other fiber material or similar composite materials. A third layer of woven reinforcement tape 309 may also be placed over the composite layer 307. In another embodiment, the reinforcement lay 309 may be omitted.

In one embodiment, the inner core 305, composite layer 307 or woven tape layer 309 may be formed with a thickened wall or region in at least one segment along the length of the pressure vessel 111. The thickened wall may form an annular protrusion 311 from the surface of the pressure vessel 111. In another embodiment, the protrusion 311 may have other shapes such as a set of bumps in an annular pattern. Any number of thickened walls may be formed in the pressure vessel 111. The thickened walls may also be positioned at any point along the length of the pressure vessel.

The pressure vessel 311 may have a tube or other elongated shape. The pressure vessel 311 may have any dimensions and shape suitable for providing sufficient strength for storing pressurized materials and for ease of transportation. The pressure vessel 111 may have a single opening in the neck portion. The opening may be fitted with a stop or valve to control the release and fill of the vessel 111. In another embodiment, the pressure vessel 11 may have a neck and opening at each end. Each opening may be fitted with a stop or valve to control the release and fill of the vessel 111.

Returning to the discussion of FIG. 1, the pressure vessels 111 are restricted in longitudinal movement with relation to the rack by a combination of the friction members attached to the positioning members and the thickened wall forming protruding sections 113A, 113B on each pressure vessel 111. The protruding sections 113A, 113B may be positioned on either side of the positioning members and friction members to inhibit longitudinal movement in either direction. The protruding sections 113A, 113B may both be adjacent to the positioning members of the stand 109A in any combination of positions including both being inside of the positioning members, both being outside and one being outside and the other inside. Additional combinations may be formed if additional protrusions, for example one on either side of a positioning member, or additional stands are present.

In one embodiment, the rack stands 109A, 109B may be secured to the exterior housing 119 through a bracket, pin, riveting, welding, or other stop or attachment mechanism. In one example embodiment, the rack stands 109A, 109B may be secured to the exterior housing 119 through a z-bar 115 and screw or rivet 117. The z-bar 115 may prevent the longitudinal movement of the rack during transportation in relation to the exterior housing. The attachment mechanism may be placed at the base of each stand 109A, 109B. In other embodiments, attachment mechanisms may secure the stands 109A, 109B along other portions of the rack such as the top of the stands or the sides of the stands. Any number of attachment mechanisms may be used to secure the rack. In one example embodiment, a set of bolts 121 may extend through the external housing 119 into the stands 109A, 109B. The bolts 121 may be inserted after loading and clamping the rack 200 with a compression mechanism or prior to loading and clamping the rack 200. Holes may be drilled through the external housing and into the stands 109A, 109B to allow the bolts 121 to be inserted. In one example embodiment, six inch washers may be placed between the external housing 119 and the head of the bolt 121.

In one embodiment, the intermodal transportation unit 100 may include a set of strong points for use in moving the unit. These strong points, e.g. corner castings, may be used by cranes or lifting machines for moving the unit without damage to the unit and its contents. These strong points may be positioned at any point on the intermodal transportation unit 100. The strong points may be fitted with hooks, loops or similar mechanism to facilitate lifting and moving the unit 100.

Figure 4:
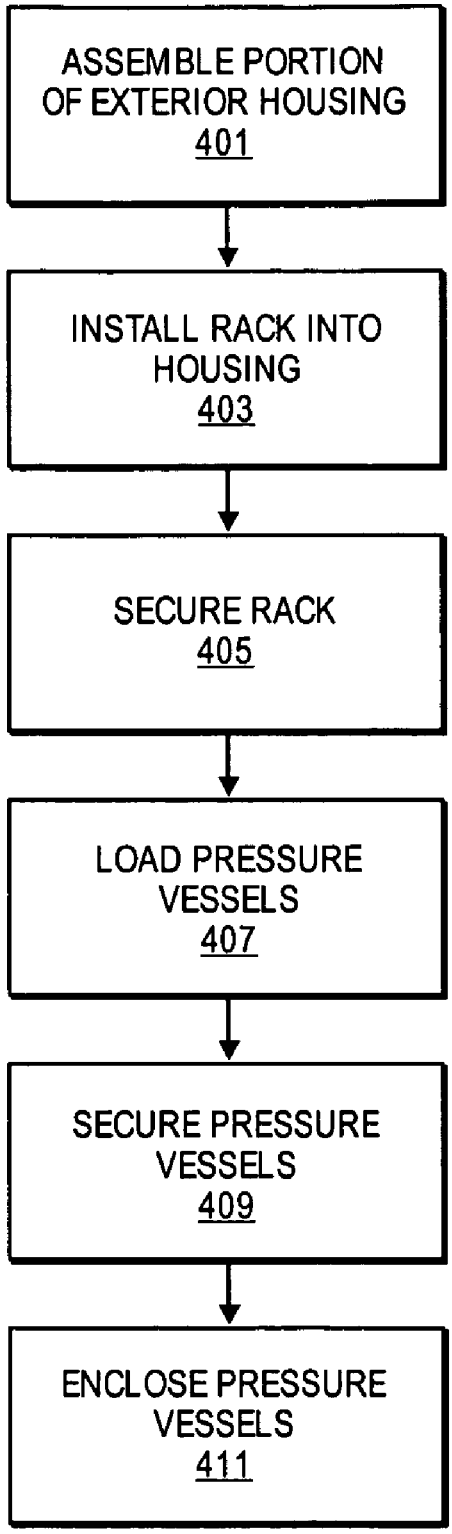
FIG. 4 is a flowchart of one embodiment of a process for constructing an intermodal transportation unit.

FIG. 4 is a flowchart of one embodiment of a process for constructing an intermodal transportation unit. In one embodiment, a portion of the exterior housing may be assembled such as the floor and sides or the entire exterior housing (block 401). A rack may then be installed into the exterior housing (block 403). The rack may be installed as a single unit or may be installed in sections such as stand by stand and crossbar by crossbar. The rack may then be secured to the exterior housing (block 405). The rack may be secured by any type of attachment mechanism. For example, a set of z-bars or bolts may be used to attach the rack stands to the exterior housing.

In one embodiment, the pressure vessels may then be placed in the rack (block 407). The positioning members may be adjustable or the crossbars and stress rods in the rack may be adjustable to facilitate the placement of the pressure vessels in the rack. In another embodiment, the pressure vessels may be placed in the rack prior to its installation into the exterior housing. After each pressure vessel is placed in the rack or after all of the pressure vessels have been placed in the rack, the pressure vessels may be secured within the rack (block 409). The pressure vessels may be secured by tightening the positioning mechanisms or crossbars or through similar mechanisms.

In one embodiment, after the pressure vessels are secured within the rack they may be enclosed by the exterior housing (block 411). The exterior housing may be completed by adding missing portions such as the top or side. In another embodiment, the rack may be loaded through the front or rear doors or other access panel. The front or rear doors may be closed or the access panel reattached to complete the enclosure.

Figure 5:
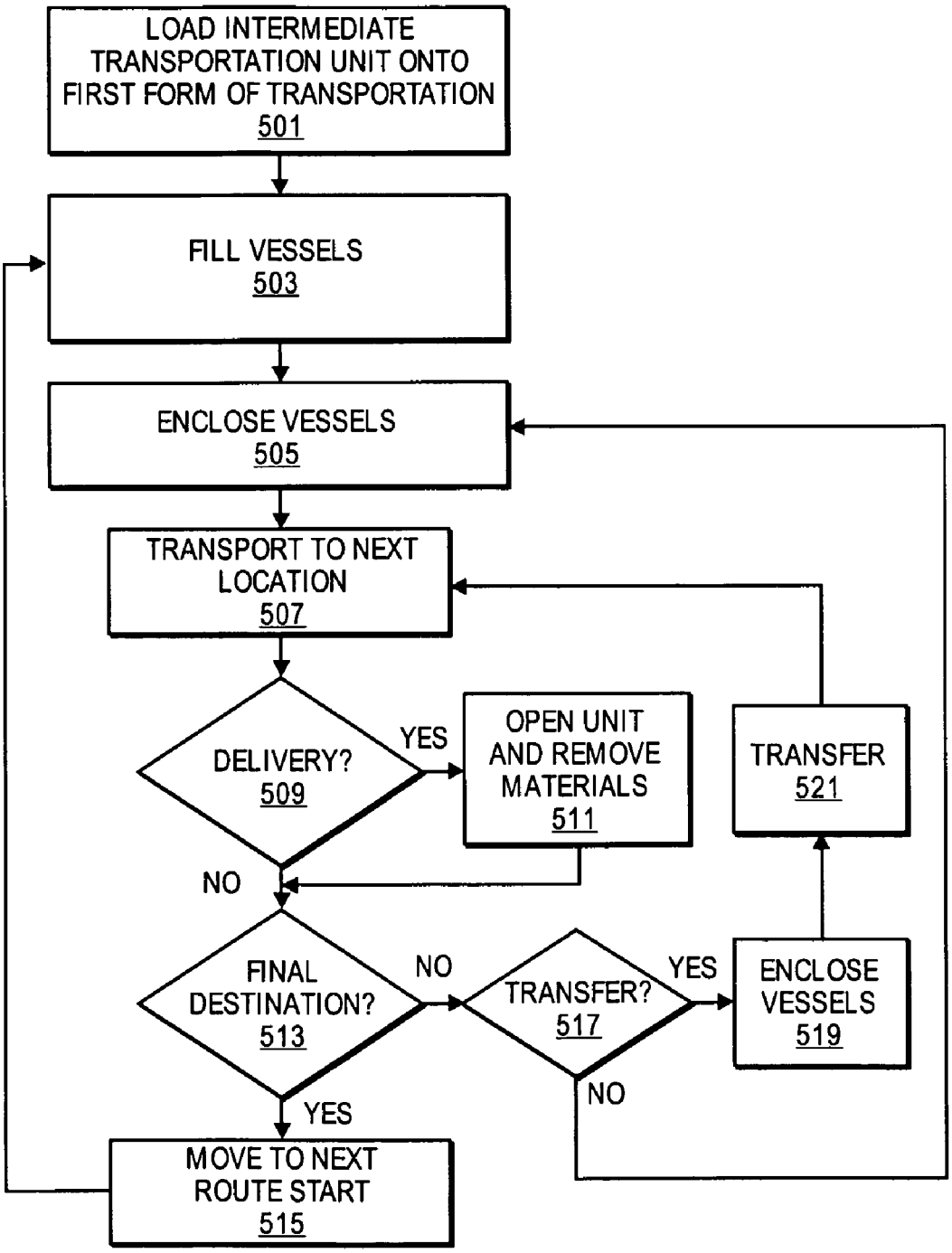
FIG. 5 is a flowchart of one embodiment of a process for transporting a material using an intermodal transportation unit.

FIG. 5 is a flowchart of one embodiment of a process for use of the intermodal transportation unit. In one embodiment, after the intermodal transportation unit has been constructed it may be loaded unto a first form of transportation, such a truck, train or ship (block 501). Any type of transport vehicle may be used. The unit may be moved by a lift, crane or similar machinery. The machinery used for the movement of the unit may be general use moving machinery instead of machinery specialized for the movement of pressure vessels.

After the intermodal transportation unit has been properly loaded onto the first vehicle, the pressure vessels may be filled with a material to be shipped (block 503). All vessels may carry the same materials or different vessels may carry different materials or amounts of materials. The pressure vessels may be filled one by one or several or all of the vessels may be filed at the same time. The vessels may be filled through an external system that connects to the neck portion and the stops or valves attached to the vessels. The external filling system may access the pressure vessels through a front or rear door or other access panel of the unit. In another embodiment, the vessels may be filled prior to being loaded into the intermodal transportation unit. In a further embodiment, a portion of the filling system may be integrated or attached to the intermodal transportation unit.

After the vessels are filled or at least a portion of the vessels are at least partially filled, the intermodal transportation unit may be closed to completely enclose the pressure vessels (block 505). The unit may be closed by closing and securing doors or replacing and securing an access panel or through a similar mechanism.

The intermodal transportation unit may be transported to an intermediate location or a first destination by the first mode of transportation (block 507). At the first location, a determination is made as to whether a delivery of materials is scheduled (block 509). If a delivery is scheduled, then the intermodal transportation unit is opened and the appropriate amount of materials, either a portion or the whole, are emptied from the appropriate pressure vessel (block 511).

After delivery, or if no delivery is scheduled at the location, then it is determined if the final destination has been reached (block 513). If the final destination has been reached then the intermodal transportation unit may be taken to the start of a new delivery route (block 515). This may include transferring the unit to a new form of transportation or the start of the new route may be the current location, the final destination. The new form of transportation may be a truck, train, ship or similar vehicle. The new form of transportation may be of the same type but a different vehicle. For example, the intermodal transportation unit may be moved from one truck to another or from one ship to another. At the start of the new route, the process may continue by filling the vessels (block 503).

If the final destination has not been reached, then a determination may be made to transfer the intermodal transportation unit to a new form of transportation (block 517). If the unit is not to be transferred, then the unit is dosed (block 505) and transported to the next location (block 507). This process may continue until the destination is reached.

If the unit is to be transferred, then the unit is closed (block 519) and then transferred to the new form of transportation (block 521). The intermodal transportation unit may be moved by standard lifting and moving equipment. The new form of transport may be any type of vehicle including the same type of vehicle from which it is transferred. After transfer, the new form of transportation may take the unit to the next location (block 507). This process may continue until the destination is reached.

In the foregoing specification, the embodiments of the invention have been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

What is claimed is:

1. An apparatus comprising:

an external housing dimensioned for intermodal transportation;

a rack within the exterior housing; and a plurality of pressure vessels wherein each of the pressure vessels comprises a metal core and a composite layer surrounding the core;

wherein the rack is configured to grippingly engage an outer circumference of each of the pressure vessels at at least two longitudinally spaced apart locations along said each of the pressure vessels and wherein the composite layer of each of the pressure vessels comprises a thickened region longitudinally adjacent to at least one of the locations where said each of the pressure vessels is engaged by the rack to prevent longitudinal movement of the pressure vessels within the rack.

2. The apparatus of claim 1, wherein the exterior housing completely encloses the rack and the pressure vessels.

3. The apparatus of claim 1, wherein the external housing comprises:

at least one stop to prevent longitudinal movement of the rack within the external housing.

4. The apparatus of claim 1, wherein the exterior housing provides access to the pressure vessels to service the pressure vessels while the pressure vessels are contained within the exterior housing.

* * * * *